US008894328B2

(12) United States Patent
Zeitler et al.

(10) Patent No.: US 8,894,328 B2
(45) Date of Patent: Nov. 25, 2014

(54) MINE ROOF BOLT ASSEMBLY

(76) Inventors: Louie Zeitler, Cape Coral, FL (US); Gregory Earl Smith, Lebanon, OH (US)

( * ) Notice: Subject to any disclaimer, the term of this patent is extended or adjusted under 35 U.S.C. 154(b) by 0 days.

(21) Appl. No.: 13/423,173

(22) Filed: Mar. 17, 2012

(65) Prior Publication Data

US 2014/0099167 A1 Apr. 10, 2014

Related U.S. Application Data

(60) Provisional application No. 61/453,700, filed on Mar. 17, 2011.

(51) Int. Cl.
*E21D 21/00* (2006.01)
*E21D 20/00* (2006.01)

(52) U.S. Cl.
CPC ..... *E21D 21/004* (2013.01); *E21D 21/0086* (2013.01); *E21D 21/008* (2013.01); *E21D 20/00* (2013.01)
USPC ..... 405/259.1

(58) Field of Classification Search
CPC ... E21D 21/00; E21D 21/008; E21D 21/0086; E21D 21/0093
USPC ..... 405/259.1, 259.5, 262, 302.1
See application file for complete search history.

(56) References Cited

U.S. PATENT DOCUMENTS

| | | | | | |
|---|---|---|---|---|---|
| 3,090,203 | A | | 5/1963 | Durget | |
| 3,133,468 | A | | 5/1964 | Cummings | |
| 3,224,202 | A | * | 12/1965 | Durget | 405/302.1 |
| 3,882,752 | A | * | 5/1975 | Gutshall | 411/371.1 |
| 4,183,699 | A | | 1/1980 | Donan, Jr. et al. | |
| 4,188,158 | A | | 2/1980 | Donan, Jr. et al. | |
| 4,275,975 | A | | 6/1981 | Morgan | |
| 4,410,296 | A | * | 10/1983 | Unrug | 405/302.1 |
| 4,518,282 | A | * | 5/1985 | Wilcox et al. | 405/302.1 |
| 4,652,178 | A | | 3/1987 | Kates et al. | |
| 4,708,559 | A | | 11/1987 | Locotos | |
| 5,064,311 | A | | 11/1991 | Giroux et al. | |
| 5,139,379 | A | | 8/1992 | Hasan et al. | |
| 5,556,234 | A | | 9/1996 | Oldsen et al. | |
| 5,628,587 | A | | 5/1997 | Lesslie | |
| 5,769,570 | A | | 6/1998 | Stankus et al. | |
| 5,791,823 | A | | 8/1998 | Blakley et al. | |
| RE35,902 | E | * | 9/1998 | Calandra et al. | 405/302.1 |
| 5,885,034 | A | | 3/1999 | Fergusson | |
| 6,056,482 | A | * | 5/2000 | Calandra et al. | 405/302.2 |
| 6,146,056 | A | * | 11/2000 | Calandra, Jr. | 405/302.1 |
| 6,682,268 | B2 | | 1/2004 | Robertson, Jr. et al. | |
| 6,939,097 | B2 | | 9/2005 | Carr et al. | |
| D576,480 | S | | 9/2008 | Stern | |
| D596,934 | S | | 7/2009 | Fitch | |
| 7,625,155 | B1 | | 12/2009 | McKinney et al. | |
| 8,052,353 | B2 | | 11/2011 | Oldsen et al. | |
| 2007/0036617 | A1 | | 2/2007 | Oldsen et al. | |
| 2010/0092250 | A1 | | 4/2010 | Zeitler | |

* cited by examiner

*Primary Examiner* — Benjamin Fiorello
(74) *Attorney, Agent, or Firm* — Tarolli, Sundheim, Covell & Tummino LLP

(57) ABSTRACT

A mine roof bolt assembly (10) comprises a bolt (20), a bearing plate (30), and a washer (40) situated between a ledge (24) of the bolt (20) and a lower face (33) of the bearing plate (30). The washer (40) includes an elbow (42), a radially inner portion (43) extending upward from the elbow (42), and a radially outer portion (44) sloping upward from the elbow (42). The elbow (42) engages an inboard location of the bolt ledge (24) so as to reduce stress on the flange (23) of the bolt (20).

20 Claims, 11 Drawing Sheets

MINE ROOF BOLT ASSEMBLY

RELATED APPLICATION

This application claims priority under 35 U.S.C. 119 to U.S. Provisional Patent Application No. 61/453,700 filed on Mar. 17, 2011. The entire disclosure of this provisional patent application is hereby incorporated by reference.

BACKGROUND

An excavation tunnel is commonly made in the side of a mountain or hill for the purpose of mining coal or removing other ore therefrom. To prevent the tunnel's roof from collapsing, mine roof bolt assemblies are typically installed throughout the mine. Such an assembly can include a bolt, a bearing plate, and a washer.

SUMMARY

A mine roof bolt assembly is adapted to insure the integrity of a bolt flange, to compensate for tilted bore installations, to increase bearing-plate yields, to boost overall system play, to guard against cut-edge contact, to accommodate loose (but customary) bolt-manufacturing tolerances, and/or to protect against bolt bending.

DRAWINGS

DESCRIPTION

Figure 1:
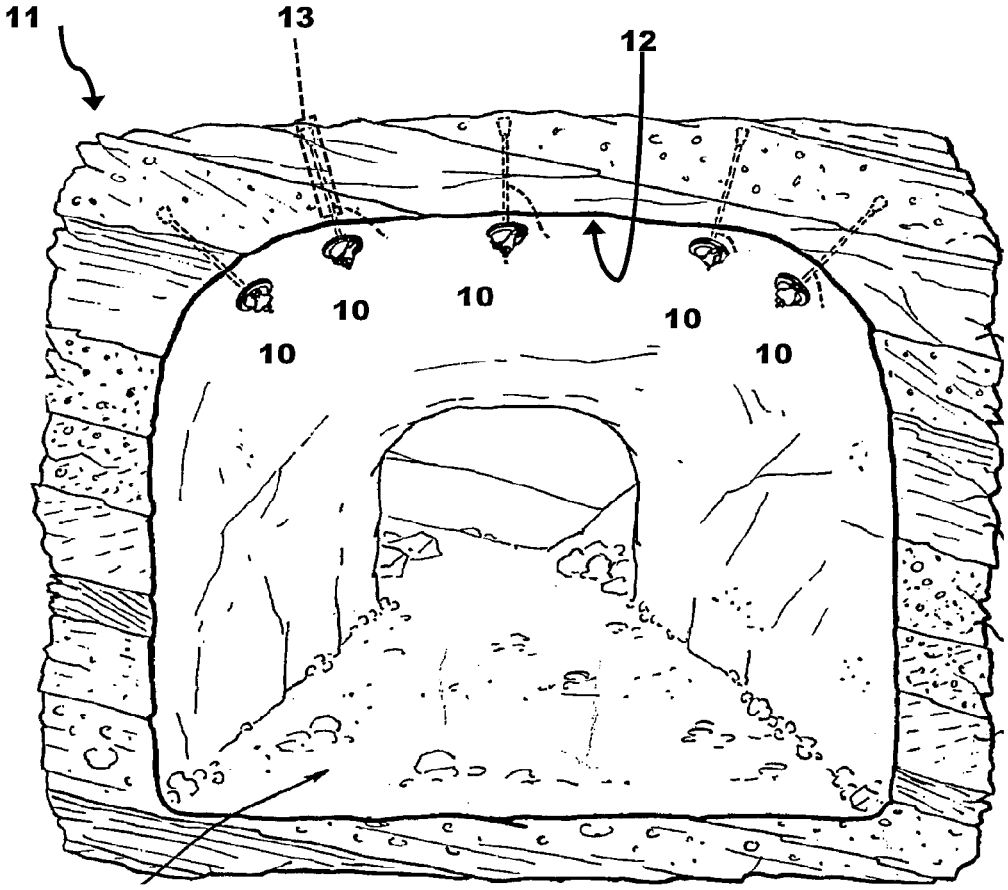
FIG. 1 is a view of a mine having a plurality of mine roof bolt assemblies installed therein.

Referring now to the drawings, and initially to FIG. 1, a plurality of mine roof bolt assemblies 10 are shown installed in an excavation tunnel 11. Such a tunnel 11 can be made in the side of a mountain or hill for the purpose of mining coal or removing other ore therefrom. As such, the tunnel 11 is typically sized so that its roof 12 is at height accommodating mining equipment and personnel. In any event, the bolt assemblies 10 are installed to prevent collapse of the tunnel roof 12.

Each bolt assembly 10 is installed in the tunnel 11 by first drilling a bore 13 upwardly through the roof 12. An elongated member of the bolt assembly 10 (namely a shaft 21, introduced below) is then inserted into the bore 13 and anchored thereto. The relevant rock formation will commonly comprise a series of strata and the bolt assemblies 10 bind adjacent strata together.

Figure 2:
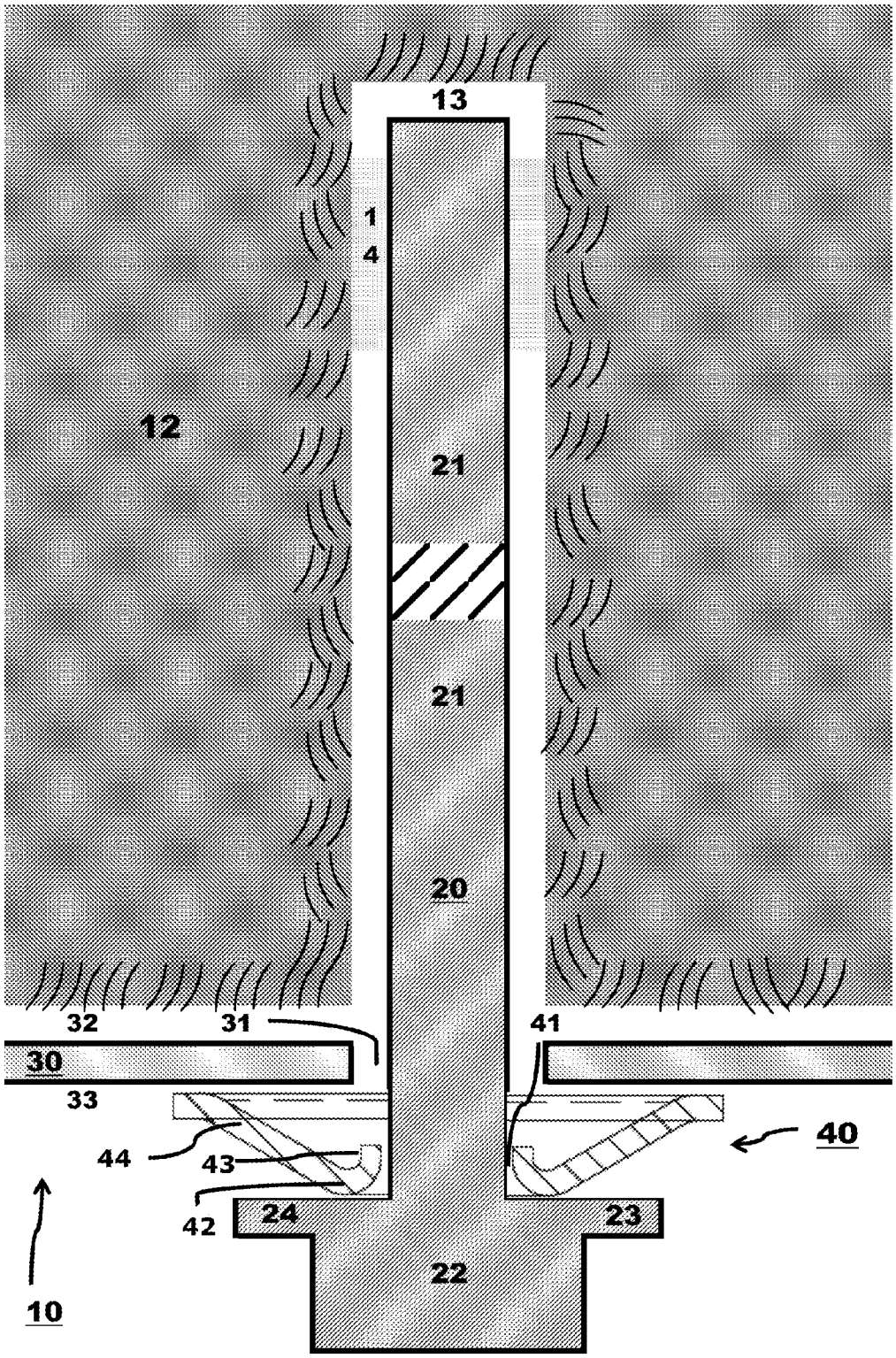
FIG. 2 is a close-up view of a mine roof bolt assembly.

Referring to FIG. 2, the illustrated mine roof bolt assembly 10 comprises a bolt 20, a bearing plate 30, and washer 40. The bolt 20 includes a shaft 21 for insertion into the bore 13 during installation of the assembly 10 in the mine tunnel 11. The shaft 21 extends through an axial aperture 31 in the plate 30 and an axial opening 41 in the washer 40.

The bolt 20 also includes a head 22 connected to the lower end of the shaft 21, a flange 23 extending radially outward from the head 22, and a ledge 24 formed by the upper side of the flange 23. The bearing plate 30 has an upper roof-contacting face 32 and a lower washer-contacting face 33. The washer 40 is situated between the flange 23 and the plate 30.

The washer 40 comprises an elbow 42, a radially inner portion 43 extending upward from the elbow 42, and a radially outer portion 44 sloping upward from the elbow 42. The elbow 42 engages the bolt's ledge 24, the inner portion 43 surrounds the axial opening 41, and the outer portion 44 contacts the lower face 33 of the bearing plate 30. As is explained in more detail below, the arrangement helps to insure the integrity of the bolt's flange 23.

Figure 3:
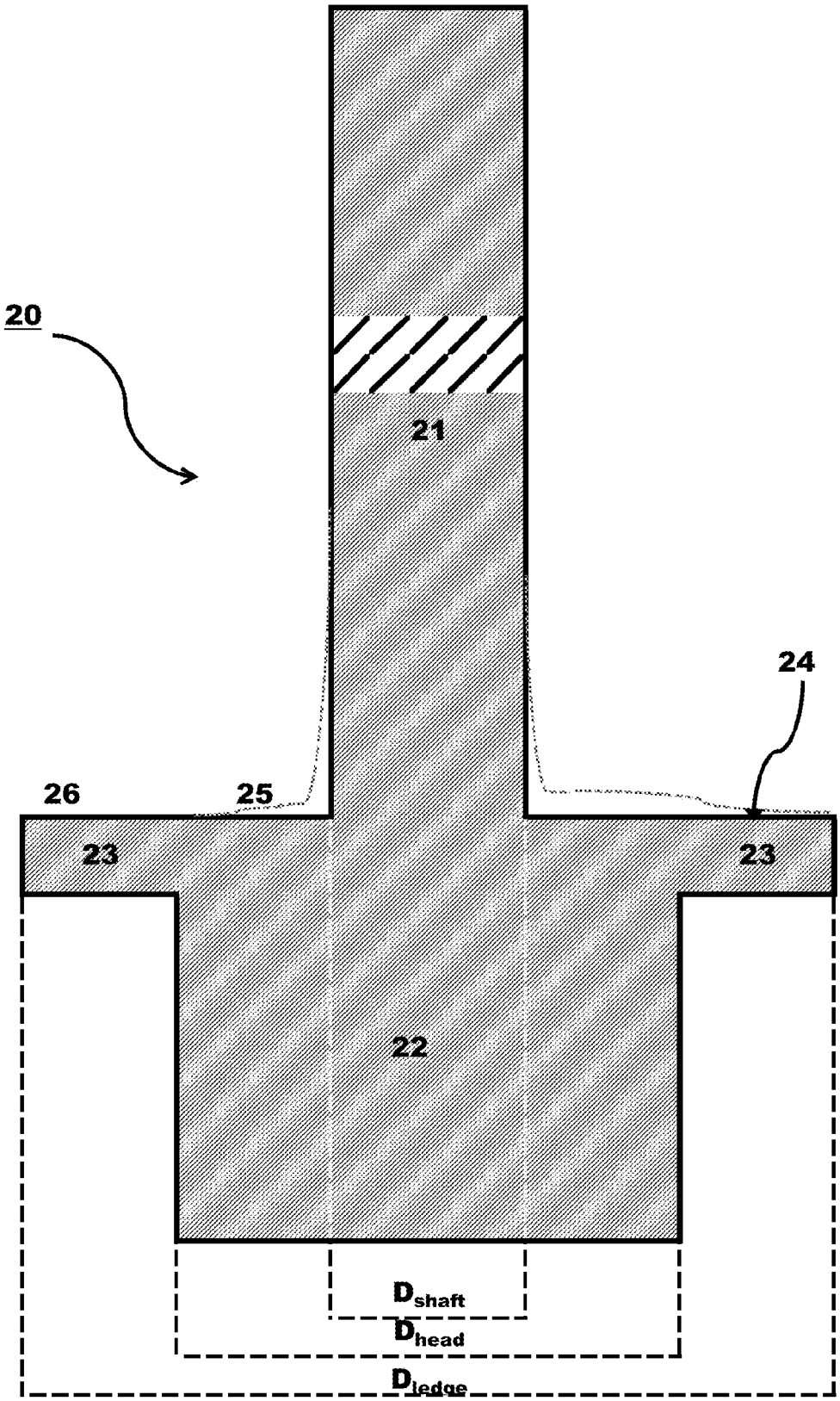
FIG. 3 is a view of the bolt of the assembly.

Referring to FIG. 3, the bolt shaft 21 has a diameter $D_{shaft}$, the bolt head 22 has a diameter $D_{head}$ greater than that of the shaft, and the bolt ledge 24 has a diameter $D_{ledge}$ greater than that of the head 22. For example, the head diameter $D_{head}$ can be at least 10%/20%/30% greater, and/or less than 80%/70%/60% greater, than the shaft diameter $D_{shaft}$. The ledge diameter D1 edge can be 10%/20%/30% greater, and/or less than 80%/70%/60% greater than the head diameter $D_{head}$. Additionally or alternatively, the shaft diameter $D_{shaft}$ can be between about 10 mm and about 50 mm, the head diameter $D_{head}$ can be between about 20 mm and about 100 mm, and/or the ledge diameter $D_{ledge}$ can be between about 30 mm and about 200 mm.

The bolt ledge 24 has a podium section 25 and a plank section 26 extending radially outward therefrom. The podium section 25 corresponds to an area extending from a diameter axially aligned with the shaft diameter $D_{shaft}$ to a diameter axially aligned with the head diameter $D_{head}$. The plank section 26 corresponds to an area extending from a diameter axially aligned with the bolt diameter $D_{head}$ to a diameter axially aligned with the ledge diameter $D_{ledge}$. As can be seen by referring briefly back to FIG. 2, the engagement of the washer's elbow 42 with the bolt ledge 24 occurs on its podium section 25, and, more particularly, on an intermediate band of this podium section.

While the illustrated bolt 20 is formed in one piece, this need not be the case. The shaft 21, the head 22, and/or the flange 23 could be separate parts. Additionally or alternatively, one or more of the individual parts 21-23 parts could itself comprise plural pieces. And the assembly of these parts/pieces could occur before, during, or after installation of the bolt assembly 10.

Although the drawings may seem to imply that the bolts 20 have clean and sharp silhouettes, this probably does not accurately reflect reality. Economic roof bolt manufacture is almost synonymous with generous tolerances, whereby bolts 20 are much more likely to have patchy profiles similar to those represented by the dashed lines shown in FIG. 3. For example, the corner transition between the shaft 21 and the ledge 24 will often involve an inconsistent taper, rather than a precise perpendicular crook. And the ledge 24 will seldom present a smooth flat platform, as an irregular topography is the prevailing norm.

Figure 4:
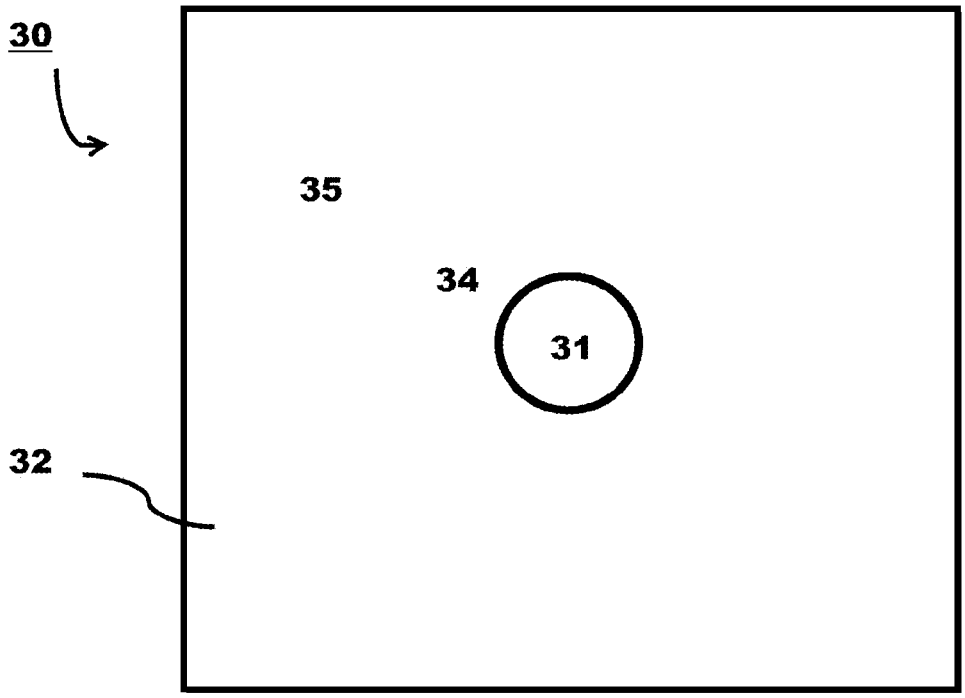
FIGS. 4-6 are views of the bearing plate of the assembly.
Figure 5:
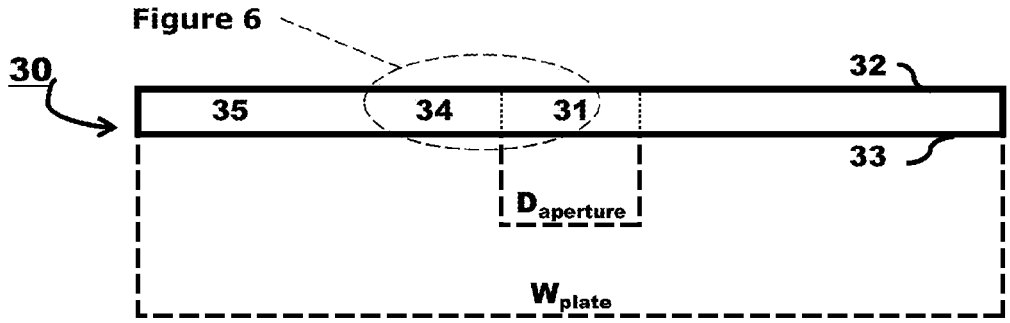
Figure 6:
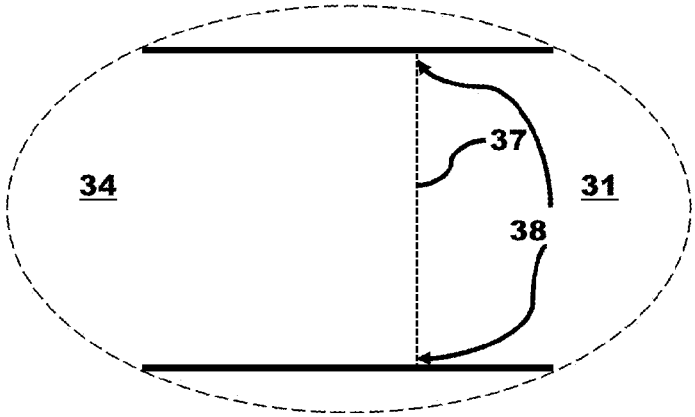

Referring now to FIGS. 4-6, the plate's axial aperture 31 has a diameter $D_{aperture}$ that is greater than the shaft diameter $D_{shaft}$ and less than the ledge diameter $D_{ledge}$. For example, the aperture diameter $D_{aperture}$ can be at least 20%/50%/10% greater than the shaft diameter $D_{shaft}$ and/or at least 40%/30%/20% less than the ledge diameter D1 edge. Additionally or alternatively, the aperture diameter $D_{aperture}$ can be less than the head diameter $D_{head}$ and/or it can be between 10 mm and 150 mm.

The illustrated plate 30 has a square perimeter but other shapes (e.g., circular, rectangular, etc.) are possible and contemplated. In any event, the plate 30 can have a width $W_{plate}$ that is at least three/five/ten times greater than the shaft diameter $D_{shaft}$. The plate width $W_{plate}$ can be, for example, between about 100 mm and about 200 mm.

The bearing plate 30 comprises a central region 34 surrounding the aperture 31 and a peripheral region 35 surrounding the central region 34. In the plate 30 shown in FIGS. 4-6, both the peripheral region 33 and the central region 32 are substantially planar and are substantially flush with each other. In other words, the plate 30 has a flat shape. With this plate geometry, almost the entire upper face 32 will contact the roof 12 of the mining tunnel 11.

The plate's aperture 31 can be viewed as being formed by a rim 36 including a shaft-surrounding wall 37. The illustrated flat bearing plate 30 can be made by stamping the aperture 31 in the central region 34. If so, the edge 38 of the rim 36 will also be its shaft-surrounding wall 37. And the thickness $T_{rim}$ of the plate's rim 36 will be the same as the thickness $T_{plate}$ of its peripheral region 35.

Figure 7:
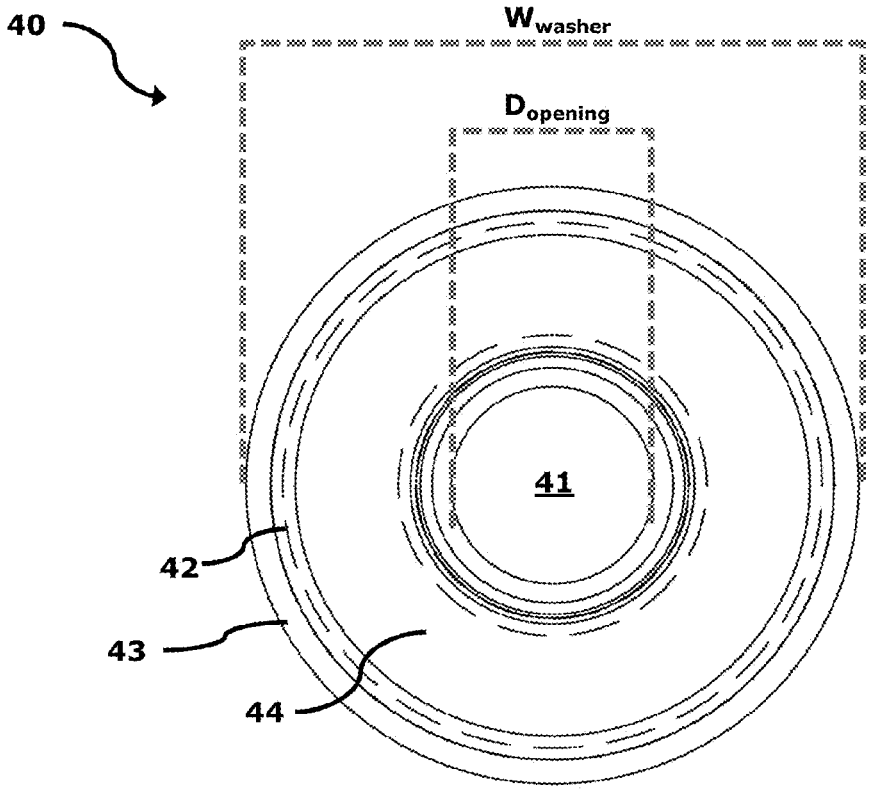
FIGS. 7-9 are views of the washer of the assembly.
Figure 8:
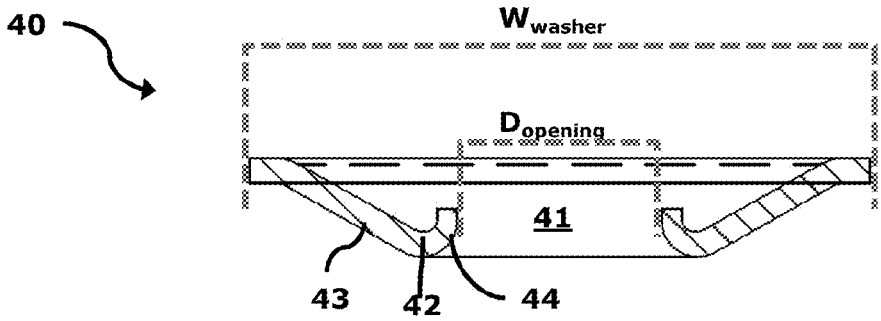
Figure 9:
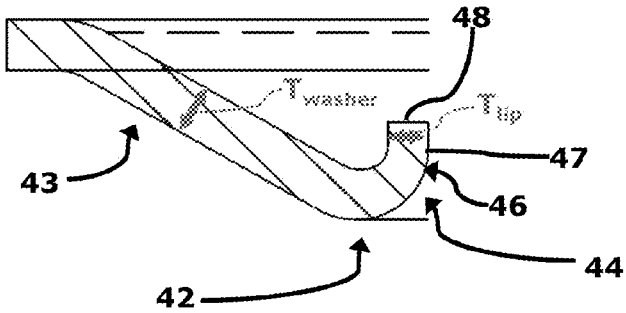

Referring now to FIGS. 7-9, the washer's axial opening 41 has a diameter $D_{opening}$ that is greater than the shaft diameter $D_{shaft}$ and less than the ledge diameter $D_{ledge}$. For example, the opening diameter $D_{opening}$ can be at least 20%/50%/10% greater than the shaft diameter $D_{shaft}$ and/or at least 40%/30%/20% less than the ledge diameter $D_{ledge}$. Additionally or alternatively, the opening diameter $D_{opening}$ can be less than the head diameter $D_{head}$ and/or between 10 mm and 150 mm.

The washer 40 can have a width $W_{washer}$ that is less than the plate width $W_{plate}$ and/or greater than the ledge diameter $D_{ledge}$. For example, the washer width $W_{washer}$ can be between 50 mm and 100 mm. The washer's radially outer portion 44 can be at least 1.2/1.5/2.0 times wider than the washer's radially inner portion 43. The inner portion 42 extends upward from the elbow 42 at a generally acute angle ex and the radially outer portion slopes upward from the elbow at a generally acute angle.

The radially inner portion 44 comprises a lip 46 having a shaft-surrounding wall 47 and a cut edge 48 that is skewed relative to the shaft 21 (i.e., it does face the shaft 21). The washer 40 is preferably produced so that the wall 47 is an extruded cylindrical surface. Specifically, for example, a hole (with a diameter less than the intended opening diameter $D_{opening}$ of the washer 40) is stamped in a metal sheet. Thereafter an extruding post (having a diameter corresponding to the intended opening diameter $D_{opening}$ of the washer 40) is protruded axially through the hole whereby the material encircling the hole forms the lip 46. With such an extrusion step, the lip 46 will have a thickness $T_{lip}$ that is less than the thickness $T_{washer}$ of the washer's outer portion 44.

Figure 10:
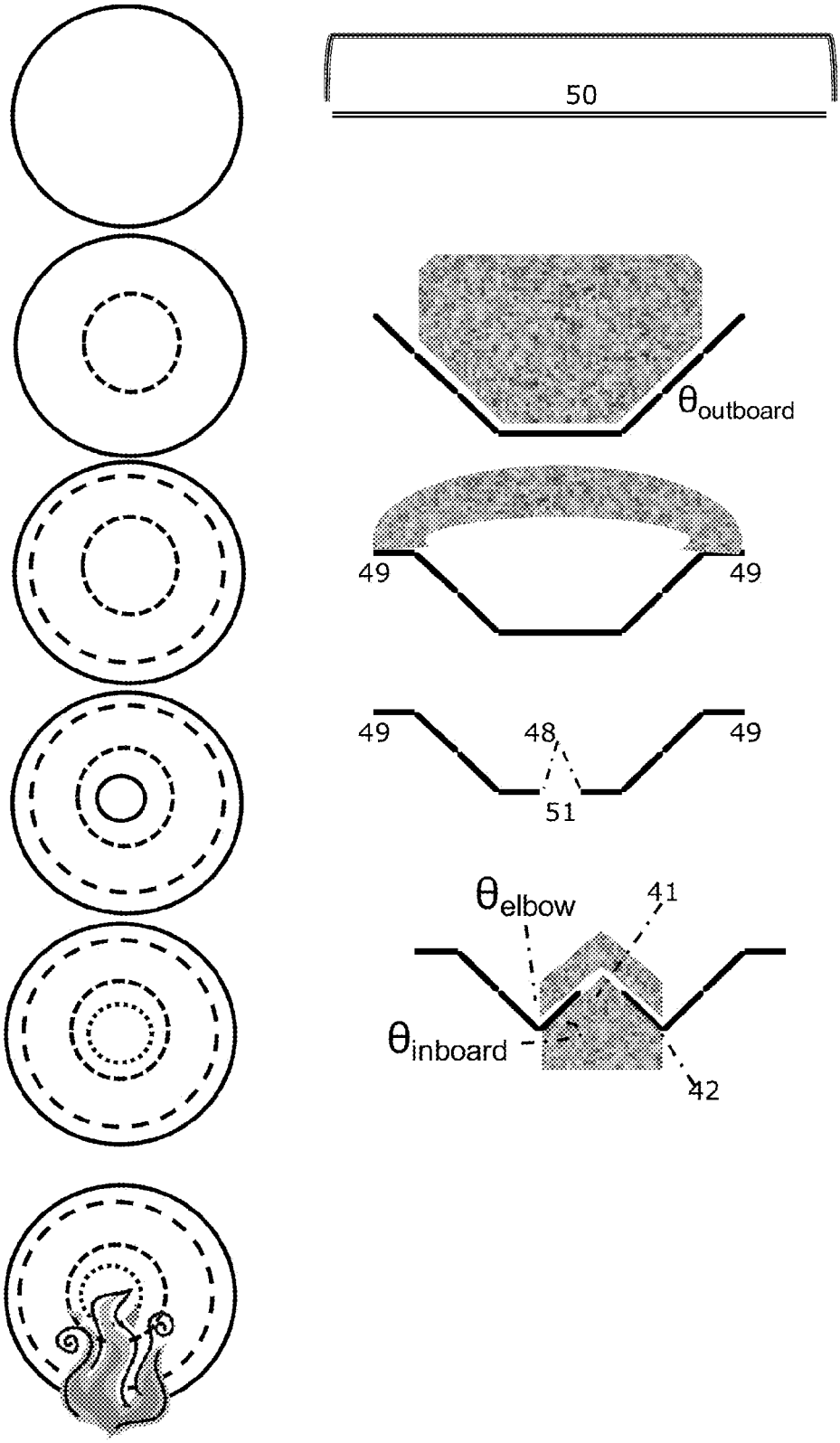
FIG. 10 shows steps involved in making the washer.

As is shown schematically in FIG. 10, the washer 40 may be produced by cutting a flat sheet into a circular blank 50, contouring an outer region of the flat circular blank 50 so as to define the outboard angle $\theta_{outboard}$, forming the washer tails 49, and cutting a hole 51 in the central area of the circular blank 50. These blank-cutting, outer-region contouring, tail-forming, and hole-cutting steps may be performed sequentially (in different orders) and/or one or more of these steps may be performed simultaneously. It may be noted that the hole-forming step creates a circular raw edge 48 positioned tangential to the central region of the blank 50. Thereafter, an extrusion step is performed wherein a punch is pushed through the hole 51 to create the shaft-surrounding wall 47 and also skew the cut edge 48 relative thereto. Thus, the shaft-surrounding wall 47 is an extruded cylindrical surface and the cut edge 48 will not face the bolt's shaft 21. The washer fabrication steps may be followed by a heat-treatment step if necessary or desired.

Figure 11:
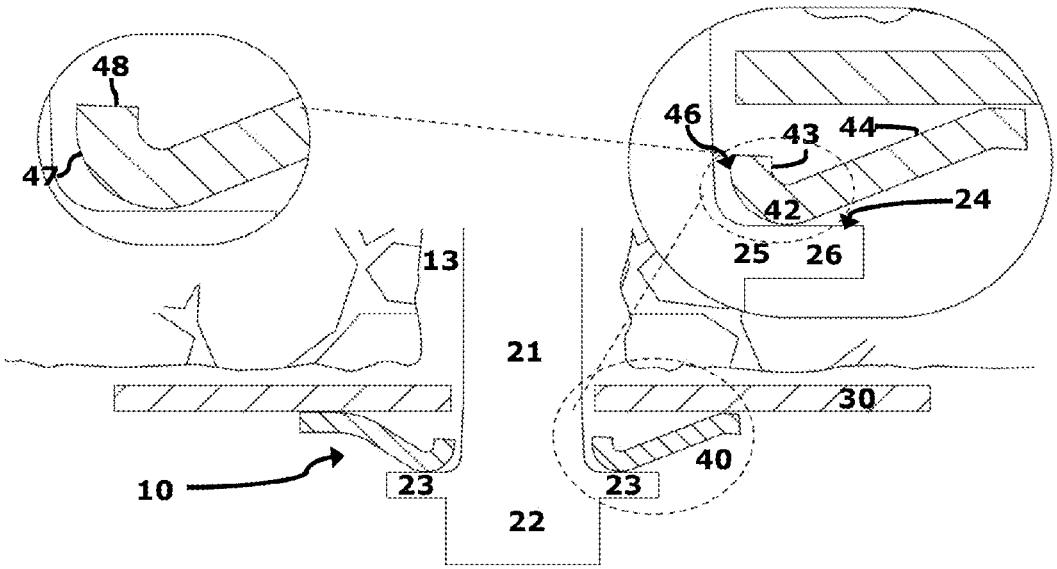
FIGS. 11-12 show the mine roof bolt assembly (with the bolt shown in FIG. 3, the bearing plate shown in FIGS. 4-6 and the washer shown in FIGS. 7-9) in different loading stages.
Figure 12:
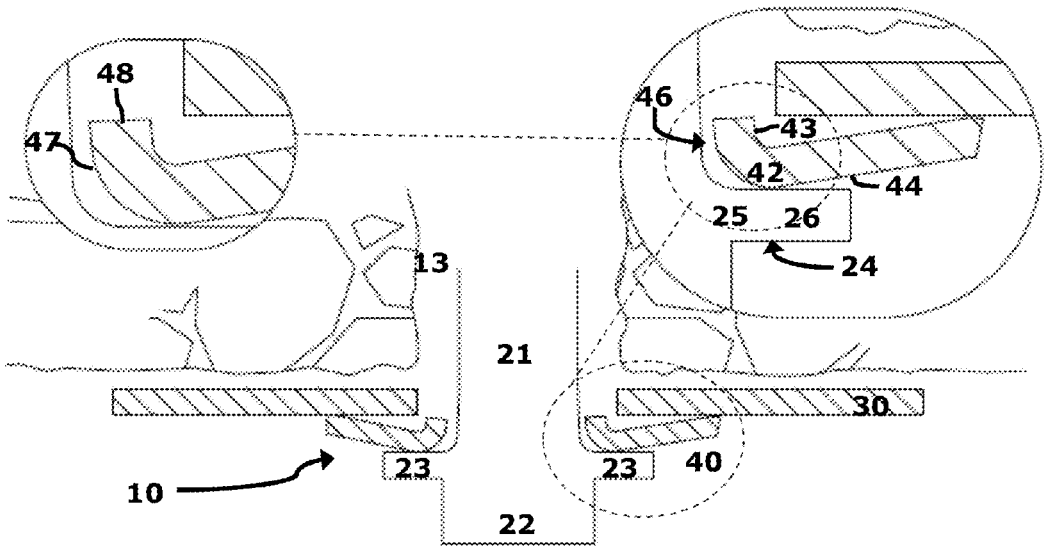

Turning now to FIGS. 11-12, the mine roof bolt assembly 10 is shown in an installation stage and a loaded stage, respectively. In both stages, only the washer's elbow 42 engages the ledge 24 and this engagement occurs on or near its inboard podium section 25. As such, the moment arm created by the downward force placed on the washer 40 is reduced, thereby decreasing stress on the vulnerable flange 23 and particularly its plank section 25.

Also, the upward angle of the inner radially portion 43 results in a clearance corner being created around the shaft 21. Such clearance allows the washer 40 to be suitable with a spectrum of shaft-to-ledge transition tapers. (As was explained, rough rather than sharp corners are typical in economically manufactured bolts). For this same reason, the angled arrangement of both the inner washer portion 43 and the outer washer portion is conducive to the accommodation of rough ledge landscapes.

Additionally, the washer design affords devised deformation that contributes to overall system movement. As is best seen by comparing FIGS. 11 and 12, the portions 43 and 44 can diverge to broaden the span, and reduce the height, of the washer 44. The elbow 42 acts as a hinge during this diversion allowing the washer 40 to open in a book-like manner.

Furthermore, the cut edge 48 of the washer 40, both before and after deformation, remains skew relative to the shaft 21. If the lip 46 were to contact the shaft 21, the extruded surface 27 would play the touching role and acts as a bearing during shaft rotation. In contrast, a cut edge (such as edge 48) in the same position would be act as a scoring mechanism during rotation of the shaft 21, thereby essentially creating a weakened seam in this very vulnerable district of the bolt 20.

In FIGS. 11-12, the bore 13 extends in a generally vertical direction and the plate 30 was horizontally positioned perpendicular to the bolt shaft 21. But as was alluded to earlier, a bore 13 can be tilted off-center with the plate 30 still horizontally positioned. In this latter arrangement, the shaft 21 is at increased risk of bending and cracking, especially at high-corrosion-attack sites near the head 22.

When the bolt assembly 10 is used in a tilted-bore situation, the elbow 42 can still engage the ledge 24 inboard thereby reducing strain on the flange 23. Also, it is the extruded surface 27 of the washer 40 that contacts the shaft 21 thereby greatly reducing stress riser. And, as shown in FIG. 12 (extreme load), one sector of the washer 40 deforms to defer bending and cracking of the body of the bolt 20.

Figure 13:
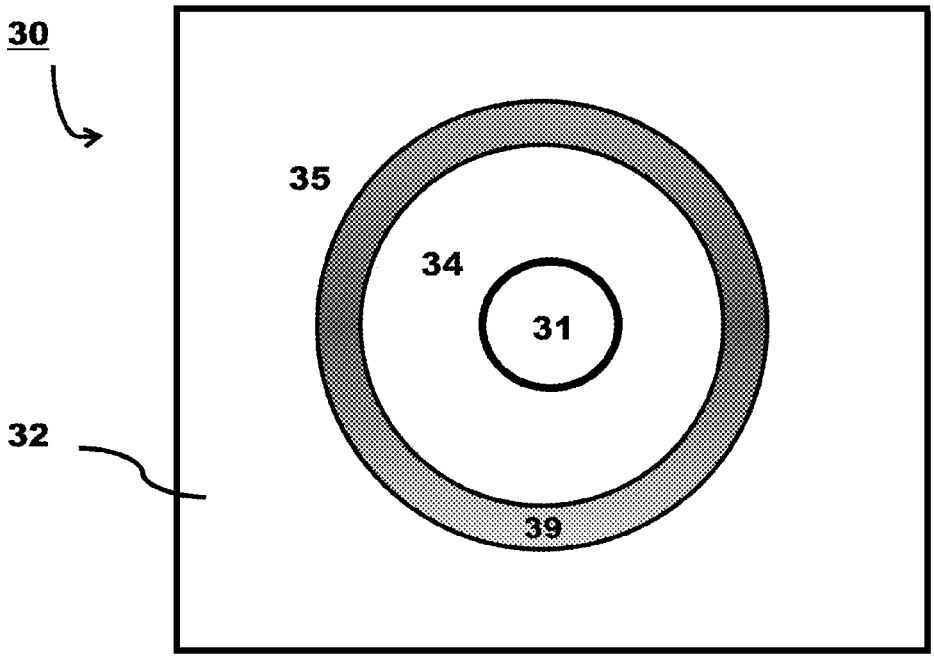
FIGS. 13-14 are views of another version of the bearing plate.
Figure 14:
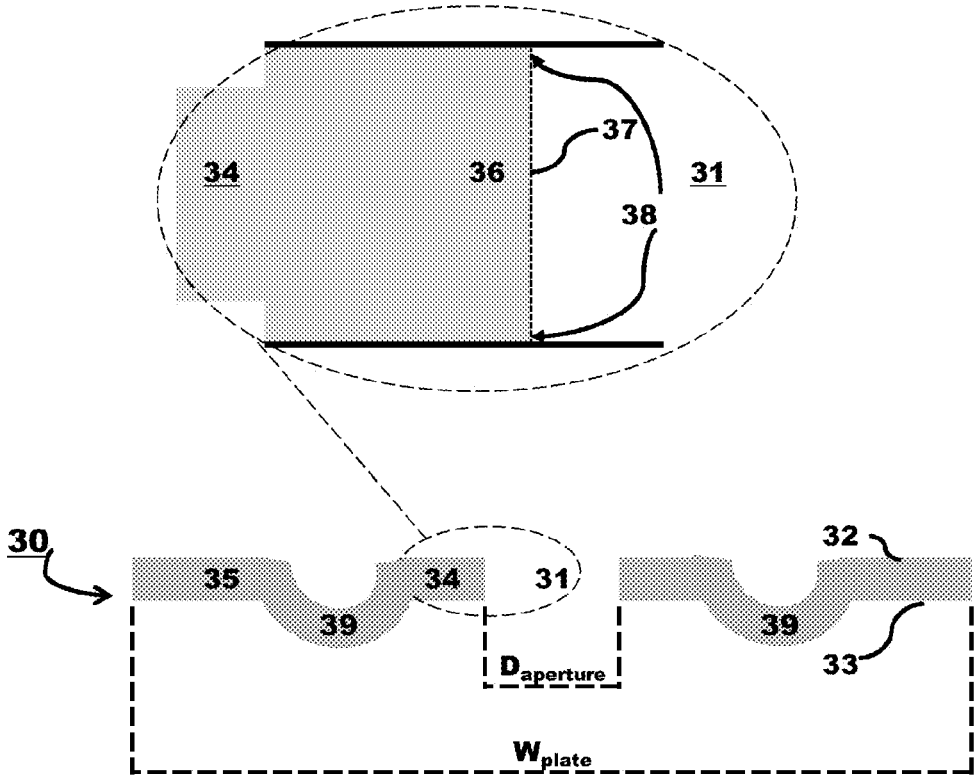

Another possible version of the plate 30 is shown in FIGS. 13-14. In this plate 30, an embossed channel 39 is situated intermediate the aperture 31 and the outer region 35. The channel 39 can have semicircular cross-sectional shape and a circular plan shape, as illustrated. Alternatively, the channel 39 can have a triangular cross-sectional shape and/or a square plan shape. In either or any event, the channel 39 can project downward from the rest of the plate's lower face 33. And the remaining regions of the plate 30 (e.g., the central region 34 and outer region 35) can have generally planar or flat profiles.

With the plate 30 shown in FIGS. 13-14, the washer 40 can be sized so that the washer 40 resides within the embossed intersection 39. This can be accomplished by tailoring the length of the outer portion 44 and/or by adjusting the slant of the outboard angle $\theta_{outboard}$. The outboard angle $\theta_{outboard}$ can be, for example, greater than greater than 10°, greater than 20°, and/or greater than 30° and it can be less than 80°, less than 70°, and/or less than 60°.

Figure 15:
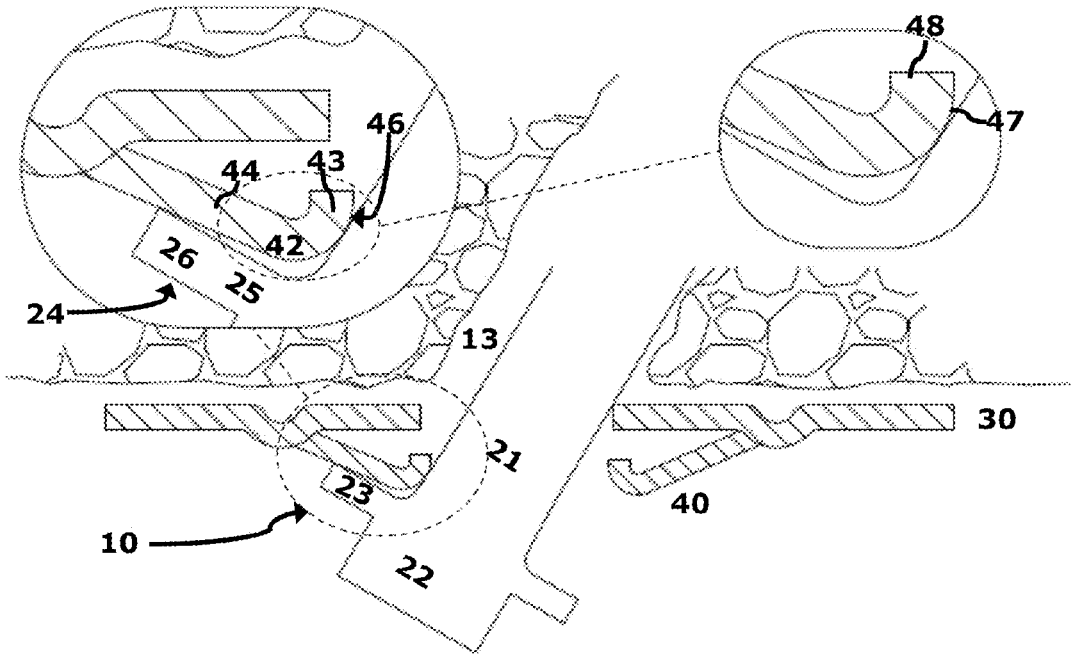
FIGS. 15-16 show the roof bolt assembly (with the bolt shown in FIG. 3, the bearing plate shown in FIGS. 13-14 and the washer shown in FIGS. 7-9) in different loading stages.
Figure 16:
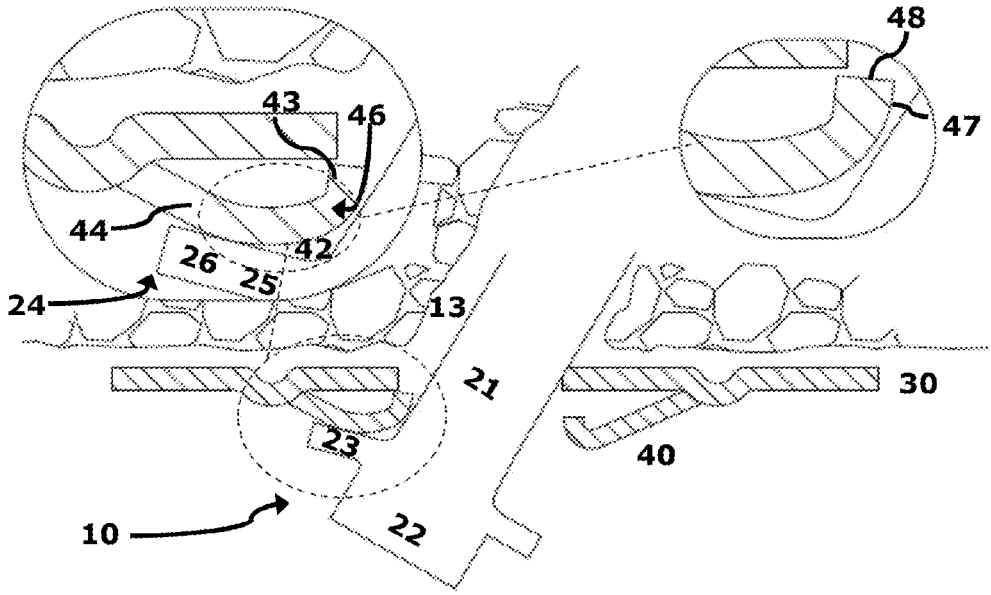

As seen in FIGS. 15-16, when the plate 30 shown in FIGS. 13-14 is used in the assembly 10, both the plate 30 and the washer 40 can yield during loading. This may be particularly important in tilted bore installations, such as depicted in the drawings.

Figure 17:
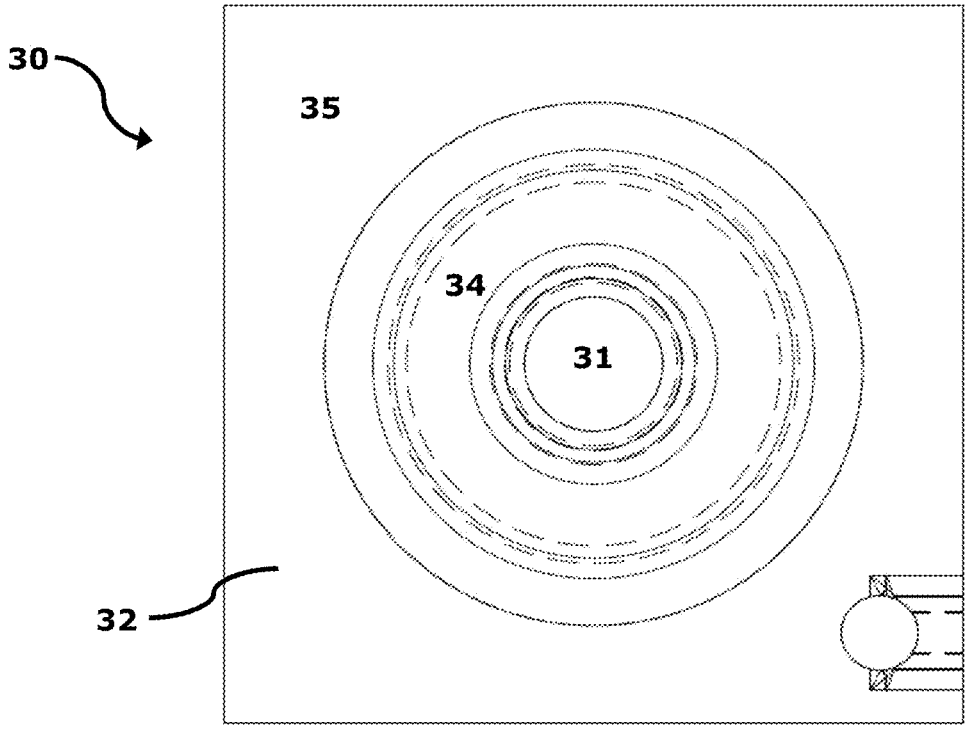
FIGS. 17-19 are views of a further version of the bearing plate.
Figure 18:
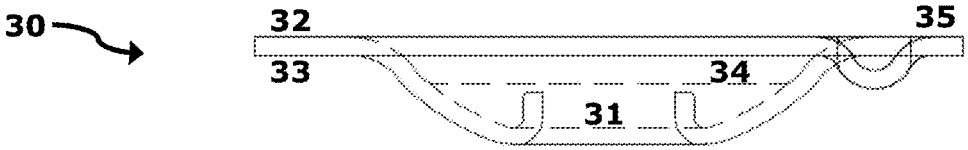
Figure 19:
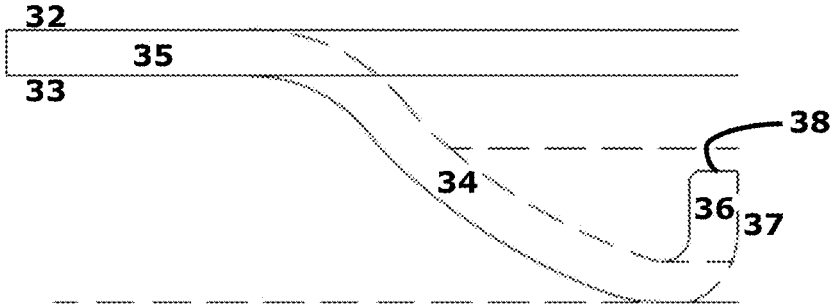

Turning now to FIGS. 17-19, another version of the bearing plate 30 is shown. In this domed bearing plate 30, the peripheral region 35 has a substantially planar shape, and the central region 35 projects outwardly (e.g., downwardly) therefrom. To this end, the central region 34 can have a substantially dome-like shape with the aperture 31 being formed in on its summit. With this plate profile, the upper face 32 of the plate 30 will contact the roof 12 only in the peripheral region 35.

The domed bearing plate 30 shown in FIGS. 17-19 can be made in the same fashion as the washer 40 (e.g., first stamping a hole in the plate material and then extruding this hole to form the aperture 41) so that its shaft-surrounding wall 37 is an extruded surface and its cut edge is skew of the shaft 21. (This will result in the thickness $T_{rim}$ of the plate's rim 36 being less than the thickness $T_{plate}$ of its peripheral region 35). When made in this manner, a smooth bearing-like surface, not a cut edge, will contact the bolt 20 during shaft rotation.

Figure 20:
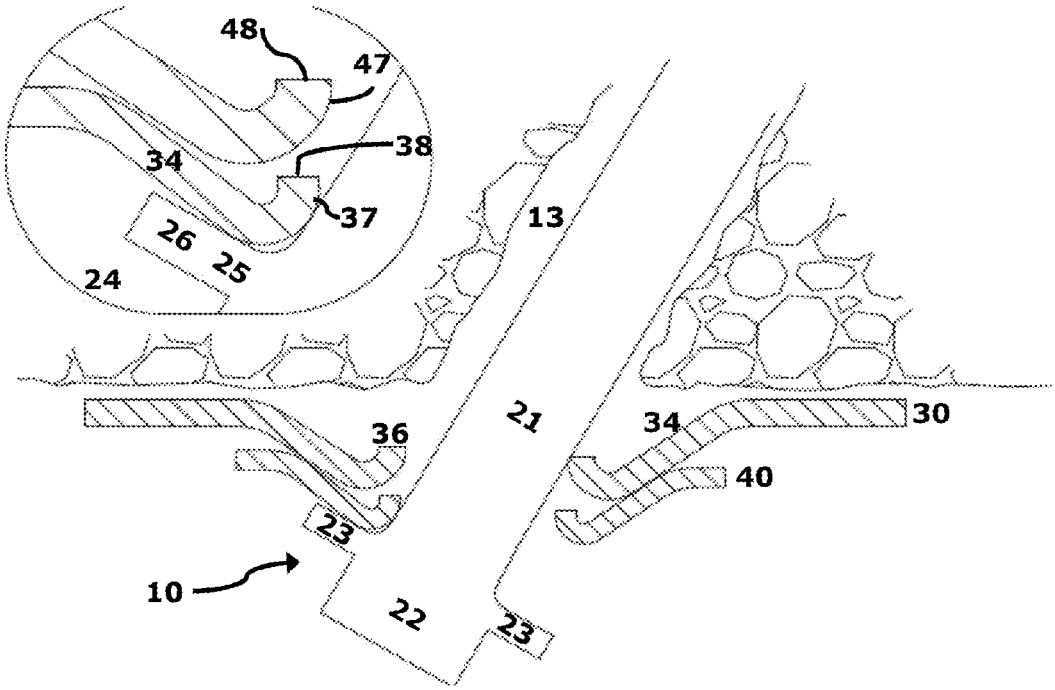
FIGS. 20-21 show the roof bolt assembly (with the bolt shown in FIGS. 3-4, the bearing plate shown in FIGS. 17-19 and the washer shown in FIGS. 7-9) in different loading stages.
Figure 21:
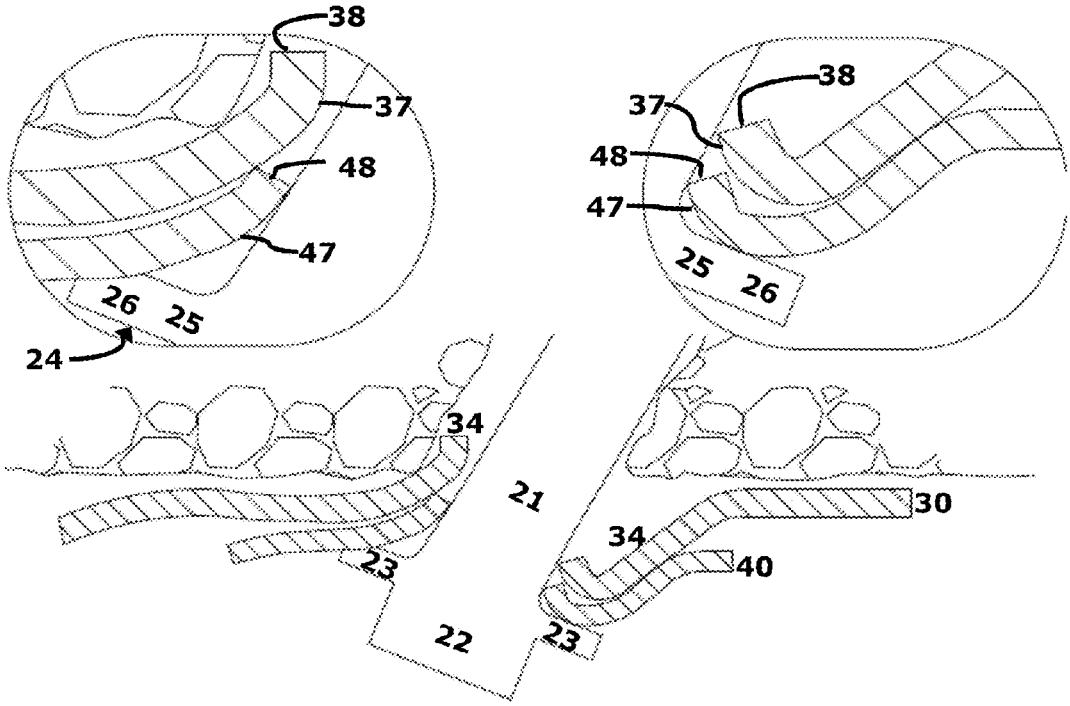

As shown in FIGS. 20-21, the washer's elbow 42 still engages the bolt ledge 24 inboard. Additionally, both the domed plate 30 and the washer 40 can yield instead of imparting bending and stress into the bolt 20. And few if any cut edges exist between the plate 30 and the shaft 21 and/or between the washer 30 and the shaft 21.

One may now appreciate that the mine roof bolt assembly 10 is adapted to insure bolt-flange integrity, to compensate for tilted bore installations, to fortify bearing-plate yields, to enhance overall movement capacity, to guard against shaft-scoring caused by cut-edge contact, to accommodate loose (but customary) bolt-manufacturing tolerances, and/or to protect against bolt bending.

The invention claimed is:

1. A mine roof bolt assembly for installation in a mine having a roof with a bore drilled therein; said bolt assembly comprising:

a bolt shaft for insertion into a bore through the roof of a mining tunnel, the bolt shaft having a diameter $D_{shaft}$;

a bolt head connected to a lower end of the shaft and having a diameter $D_{head}$ greater than the diameter $D_{shaft}$ of the shaft;

a flange extending radially outward from the bolt head and having an upper side forming a bolt ledge, the bolt ledge having a diameter $D_{ledge}$ that is greater than the diameter $D_{head}$ of the bolt head;

a bearing plate including an axial aperture through which the shaft extends, the plate having an upper roof-contacting face and a lower washer-contacting face;

a separate washer which is not interconnected with the bearing plate, the washer including an axial opening through which the shaft extends, the washer being situated between the bolt ledge and the lower washer-contacting face of the bearing plate; wherein said washer comprises:

an elbow engaging the bolt ledge inboard from its diameter $D_{ledge}$;

a radially inner portion extending upward from the elbow and surrounding the axial opening; and a radially outer portion sloping upward from the elbow and contacting the lower face of the bearing plate.

2. A mine roof bolt assembly as set forth in claim 1, wherein the bolt ledge has a podium section and a plank section extending radially outward therefrom;

wherein the podium section corresponds to an area extending from a diameter axially aligned with the shaft diameter $D_{shaft}$ to a diameter axially aligned with the bolt's diameter $D_{head}$, wherein the plank section corresponds to an area extending from a diameter axially aligned with the bolt's diameter $D_{head}$ to the diameter $D_{ledge}$ of the ledge; and wherein the engagement of the washer's elbow with the bolt ledge occurs on its podium section.

3. A mine roof bolt assembly as set forth in claim 2, wherein the engagement of the washer's elbow occurs in an intermediate band on the podium section.

4. A mine bolt assembly as set forth in claim 3, wherein the washer's axial opening has a diameter $D_{opening}$ that is greater than the shaft diameter $D_{shaft}$ and less than the ledge diameter $D_{ledge}$.

5. A mine bolt assembly as set forth in claim 4, wherein the washer opening's diameter $D_{opening}$ is at least 2% greater than the shaft diameter $D_{shaft}$.

6. A mine bolt assembly as set forth in claim 5, wherein the washer opening's diameter $D_{opening}$ is at least 20% less than the ledge diameter $D_{ledge}$.

7. A mine bolt assembly as set forth in claim 4, wherein the washer opening's diameter $D_{opening}$ is less than the head diameter $D_{head}$.

8. A mine bolt assembly as set in claim 7, wherein the washer opening's diameter $D_{opening}$ is between 10 mm and 150 mm.

9. A mine bolt assembly as set forth in claim 1, wherein the washer has a width $W_{washer}$ that is less than the width $W_{plate}$ of the plate.

10. A mine bolt assembly as set forth in claim 1, wherein the washer's radially outer portion is at least 1.2 times wider than the washer's radially inner portion.

11. A mine bolt assembly as set forth in claim 1, wherein the washer's radially inner portion comprises a lip having a shaft-contacting wall.

12. A mine bolt assembly as set forth in claim 11, wherein the shaft-contacting wall is an extruded cylindrical surface.

13. A mine bolt assembly as set forth in claim 11, wherein the lip has a thickness $T_{lip}$ that is less than the thickness $T_{washer}$ of the washer's outer portion.

14. A mine bolt assembly as set forth in claim 11, wherein the lip has an edge that faces away from the shaft.

15. A mine bolt assembly as set forth in claim 1, wherein the bearing plate comprises a central region surrounding the aperture and a peripheral region surrounding the central region, wherein the peripheral region and central region are planar and substantially flush with each other.

16. A mine bolt assembly as set forth in claim 15, wherein the bearing plate has a flat shape.

17. A mine bolt assembly as set forth in claim 16, wherein the bearing plate has an embossed channel situated intermediate the aperture and the peripheral region.

18. A mine bolt assembly as set forth in claim 1, wherein the bearing plate comprises a central region surrounding the aperture and a peripheral region surrounding the central region, wherein the central region has a dome-like shape and the peripheral region has a substantially planar shape, wherein the central region comprises a shaft-surrounding wall which is an extruded surface and has a cut edge skew of the bolt shaft.

19. A method of installing the mine bolt assembly set forth in claim 1 in a mining tunnel, said method comprising the steps of:

providing a bore in the roof of the mining tunnel, inserting the bolt shaft into the bore, and manipulating the mine roof bolt assembly so that the plate's upper surface engages the roof and the washer is compressed between the bolt's ledge and the plate's lower surface;

wherein the shaft contacts an extruded surface of the washer during the turning step.

20. A mining tunnel comprising a roof and a plurality of mine roof bolt assemblies set forth in claim 1 installed therein, wherein the bolt shafts are inserted through respective bores in the roof of the tunnel and the plates' upper surfaces engage the roof.

* * * * *